United States Patent [19]

Herrmann, Jr.

[11] 4,193,655

[45] Mar. 18, 1980

[54] FIELD REPAIRABLE CONNECTOR ASSEMBLY

[75] Inventor: Henry O. Herrmann, Jr., Mt. Joy, Pa.

[73] Assignee: AMP Incorporated, Harrisburg, Pa.

[21] Appl. No.: 926,581

[22] Filed: Jul. 20, 1978

[51] Int. Cl.[2] ..... H01R 13/04; H01R 23/02

[52] U.S. Cl. ..... 339/31 R; 339/59 M; 339/94 M; 339/103 M; 339/186 M

[58] Field of Search ..... 339/31, 59, 60, 62, 339/63, 90, 103, 185, 186, 211, 94

[56] References Cited

U.S. PATENT DOCUMENTS

| | | | |
|---|---|---|---|
| 2,563,762 | 8/1951 | Uline et al. | 339/63 M |
| 3,402,382 | 9/1968 | De Tar | 339/103 |
| 3,576,517 | 4/1971 | Johnson et al. | 339/103 |
| 3,588,783 | 6/1971 | Newman | 339/59 |
| 3,649,956 | 3/1972 | Vrobel | 339/103 B |
| 3,719,918 | 3/1973 | Kerr | 339/90 R |
| 3,721,939 | 3/1973 | Paugh | 339/103 |
| 3,850,495 | 11/1974 | Glover | 339/103 M |
| 3,885,849 | 5/1975 | Bailey | 339/31 R |
| 3,986,765 | 10/1976 | Shaffer et al. | 339/90 R |

FOREIGN PATENT DOCUMENTS

| | | | |
|---|---|---|---|
| 1465935 | 1/1969 | Fed. Rep. of Germany | 339/31 R |
| 831884 | 4/1960 | United Kingdom | 339/186 M |
| 1047326 | 11/1966 | United Kingdom | 339/59 R |
| 1401373 | 7/1975 | United Kingdom | 339/90 R |

*Primary Examiner*—Neil Abrams
*Attorney, Agent, or Firm*—Russell J. Egan

[57] ABSTRACT

An electrical connector assembly is disclosed having the capability of being field repairable as well as being assembled in a plurality of configurations by appropriate selection of parts. The assembly includes mating plug and receptacle shells, a pin insert and a socket insert each capable of being received in either shell aligned in a selected one of a plurality of positions and a mating socket terminal and pin terminal each being mountable in either said socket or said pin insert. The connector assembly further includes rubber boots to enclose conductors leading to the respective terminals as well as a rear sealing gasket making a sealing engagement between a respective pin or socket insert and the sealing boots, and the respective socket or plug shells. The connector assembly also includes a compression ring for applying compression to the sealing gasket to effect the sealing engagement, a compression cone providing rear gasket compression, strain relief for the conductors, interfacial seals, and a spring loaded coupling ring. The above itemized parts can be arranged in any one of a number of configurations according to the particular local needs with the entire assembly being such that it can be easily disassembled for repair in the field without requiring the use of extensive and particularized tools.

13 Claims, 8 Drawing Figures

FIELD REPAIRABLE CONNECTOR ASSEMBLY

BACKGROUND OF THE INVENTION

1. The Field Of The Invention

The present invention relates to an electrical connector assembly and in particular to an assembly in which the terminals, terminal shells, and terminal inserts can be interchanged to provide a wide variety of connector configurations.

2. The Prior Art

There are often instances when it is highly desirable to arrange the components of an electrical connector for customized installation and yet to have such an assembly arrangement that it can be readily revised and/or repaired locally without requiring the use of extensive or particular tools. Many of the known electrical connector assemblies which are sold in kit form can be field assembled but they cannot provide a variety of connector configurations and often times cannot be readily disassembled for maintenance and/or repair.

SUMMARY OF THE INVENTION

The subject electrical connector assembly includes a plug shell, a receptacle shell, a socket insert, a pin inset, a plurality of socket terminals, and a plurality of pin terminals. The plug and receptacle shells are designed to be intermating. Likewise the socket and pin inserts are designed to be intermated and also to be mountable in either the receptacle shell or the plug shell. The assembly is also provided with a plurality of sealing means to seal both the front and rear surfaces of the respective members as well as means to provide strain relief and coupling means providing spring biased mating of the members.

It is therefore an object of the present invention to produce an electrical connector assembly which can be assembled in a plurality of configurations.

It is a further object of the present invention to produce an electrical connector assembly having six major components, namely, a receptacle shell, a plug shell, a socket insert, a pin insert, a pin terminal, and a socket terminal, said components being capable of assembly in a wide variety of configurations.

It is a further object of the present invention to produce an electrical connector assembly having a plug shell and a receptacle shell each of which is capable of receiving therein a pin insert or a socket insert each of which is capable of receiving therein a pin terminal or a socket terminal, respectively.

It is a further object of the present invention to produce an electrical connector assembly having members which can be assembled in a wide variety of configurations with the assembled mating members having sealing means both on the front and rear surfaces, having strain relief for conductors applied thereto and biased coupling of the members together.

It is yet another object of the present invention to produce an electrical connector assembly in which the inserts mounted in the respective shells can be oriented in a variety of positions for customized assembly assuring correct mating of a variety of such connector assemblies.

It is a further object of the present invention to produce an electrical connector assembly which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
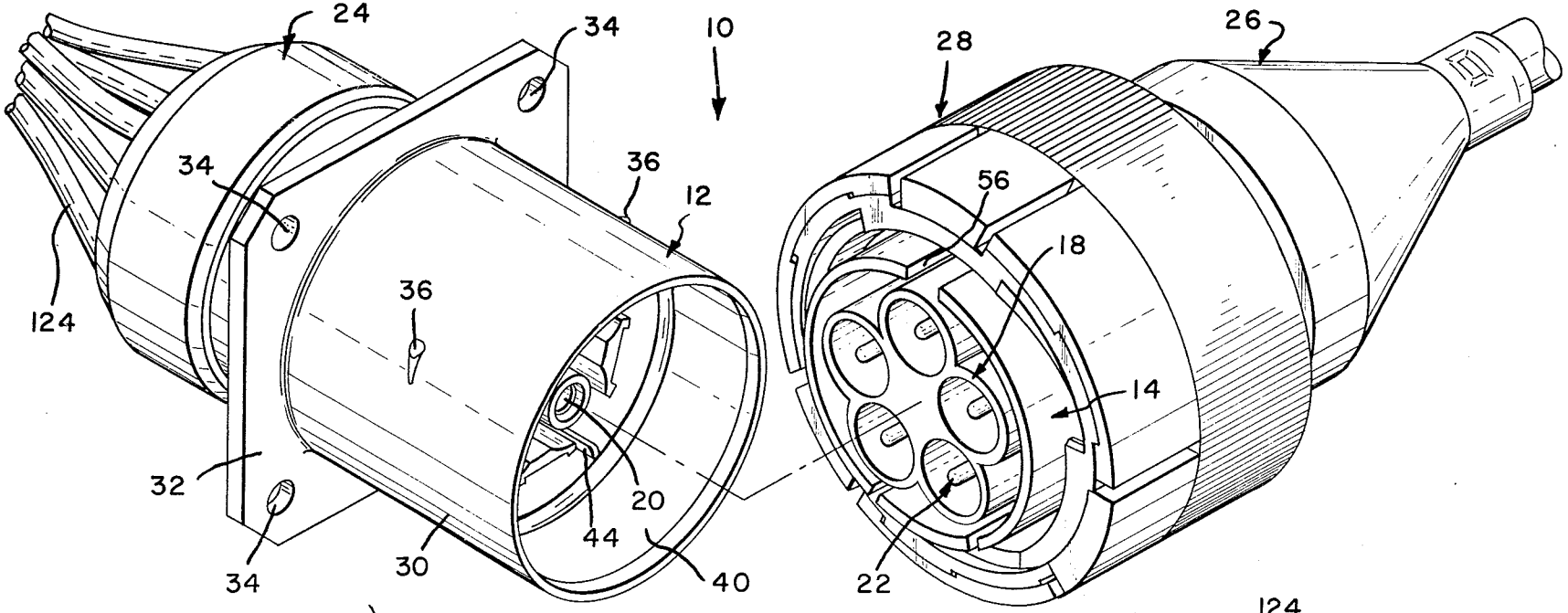
FIG. 1 is an exploded perspective view of the subject electrical connector assembly.
Figure 2:
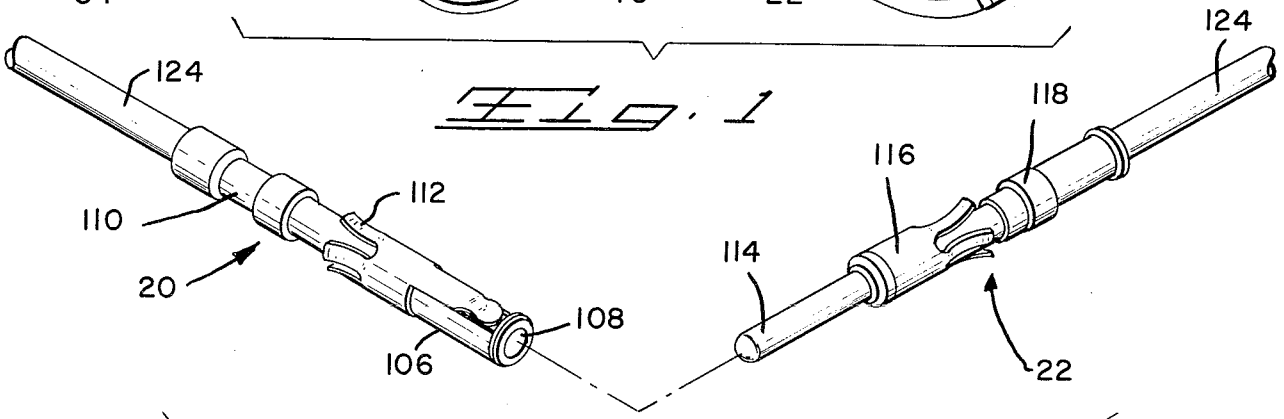
FIG. 2 is an exploded perspective view of a pin and a socket terminal used in the subject connector assembly.

The subject electical connector assembly 10 includes a receptacle shell 12, a plug shell 14, a socket insert 16, a pin insert 18, a socket terminal 20, a pin terminal 22, a rear sealing assembly 24, a rear strain relief and sealing assembly 26, and a coupling ring assembly 28. Each of these components and assemblies can be mounted in a variety of configurations with the other components to form an entire connector assembly, as will be discussed in detail below.

The receptacle shell 12 has a generally cylindrical profile 30 with an intermediate, outwardly directed integral mounting flange 32 having a plurality of mounting apertures 34 therein. The exterior of one end of the cylinder is substantially smooth with the exception of at least one locking lug 36. The other end of the cylinder is provided with an externally threaded portion 38. The bore 40 has an inner profile defined by an elongated major key 42 and two minor keys 44, 46. There is also an inwardly directed flange 48 having polarized keyways 50 therein.

The plug shell 14 likewise has a substantially cylindrical configuration and is profiled to be received in the bore 40 in the receptacle shell. The plug shell includes an outwardly directed, integral, intermediate flange 52, external threads 54 on one end of the cylinder, elongated major keyway 56, and minor keyways 58, 60 on the opposite end. An inwardly directed annular flange 62 in bore 64 has a plurality of polarized keyways 66 therein. The shell also includes an outwardly directed annular groove 68 which receives an O-ring 70 therein.

Figure 4:
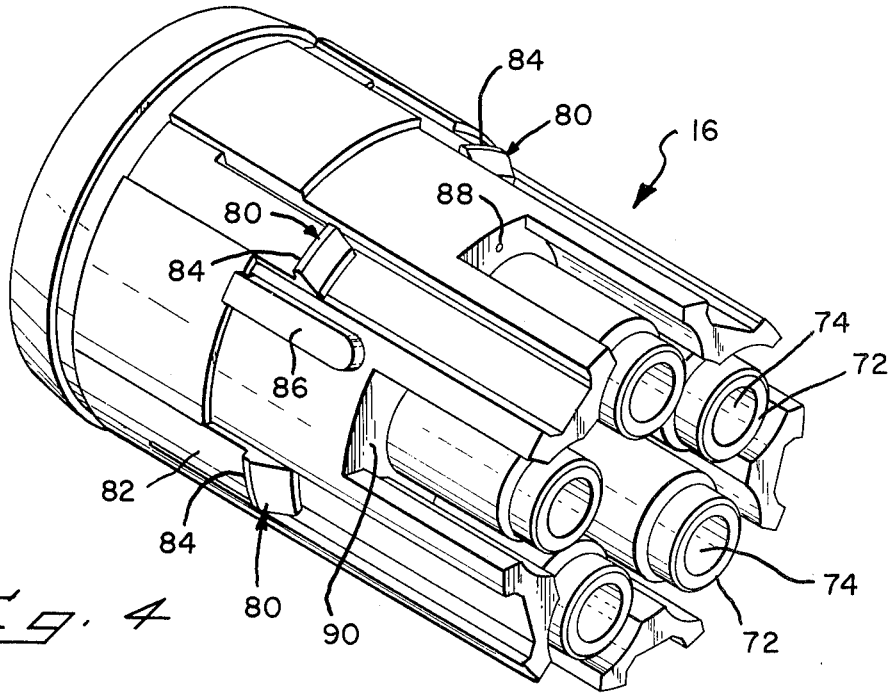
FIG. 4 is a perspective view showing the details of the socket insert portion of the subject electrical connector assembly.
Figure 5:
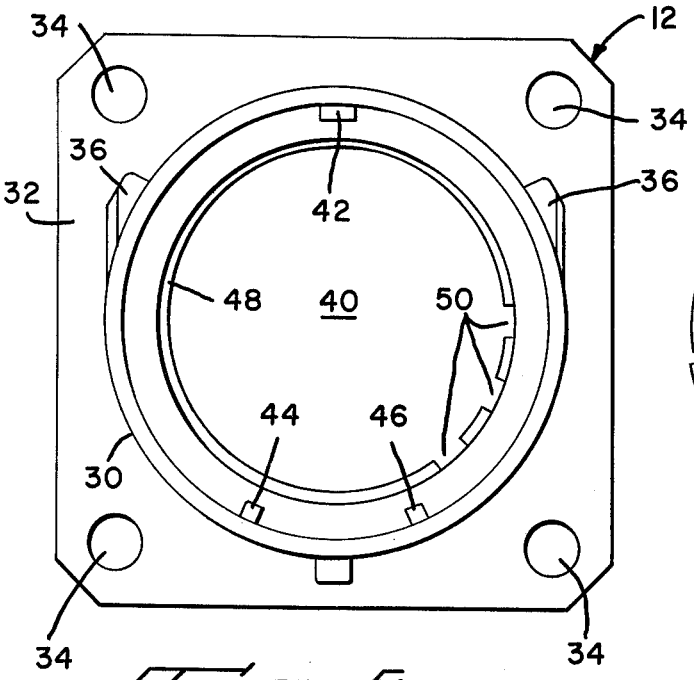
FIG. 5 is an end view of the receptacle shell.
Figure 6:
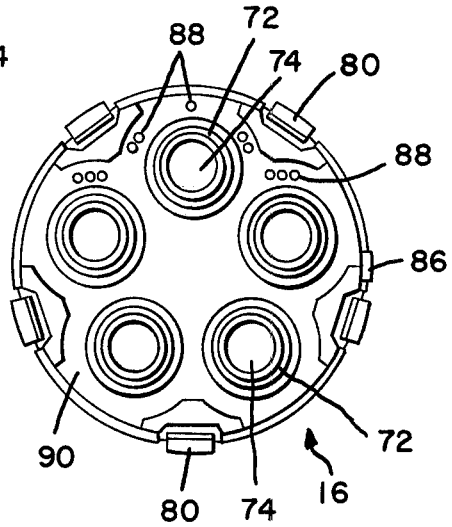
FIG. 6 is a mating end view of the socket insert.
Figure 7:
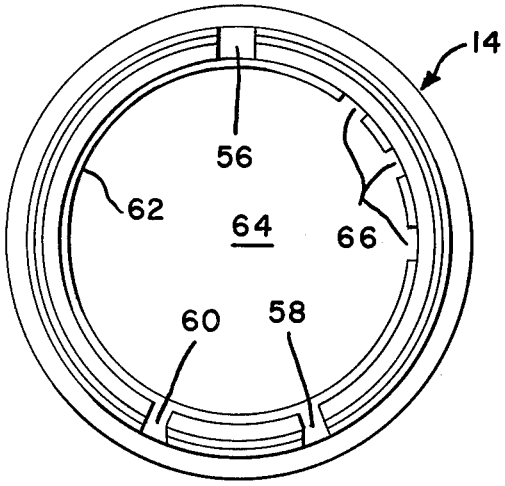
FIG. 7 is a mating end view of the plug shell.
Figure 8:
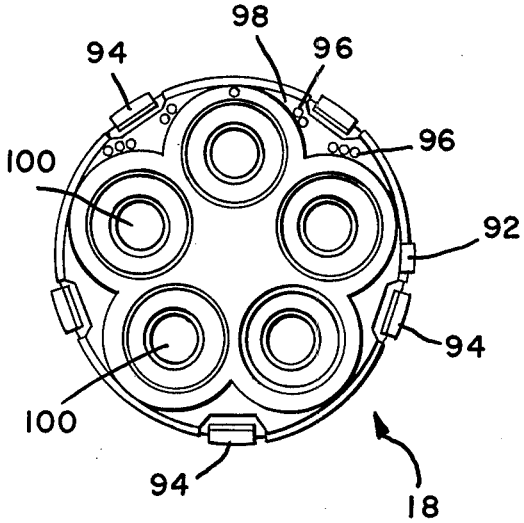
FIG. 8 is a mating end view of the subject pin insert.

The socket insert 16 is shown in both FIGS. 4 and 6. The socket insert is an integral body of plastics material having a substantially cylindrical outer profile. The embodiment shown is configured to accommodate five terminals in socket portions 72 each of which has a profiled bore 74 including an inwardly directed locking flange 76 and an enlarged profiled sealing boot receiving portion 78. The insert also includes a plurality of outwardly directed mounting latches 80, each of which includes a cantilever arm 82 and an outwardly directed shoulder 84. The insert also includes an integral key 86 and polarizing indicia 88 on a mating face 90.

The pin insert 18 likewise has a substantially cylindrical outer profile adapted to be received in either bore 40 or 64 and includes a key 92 and a plurality of outwardly directed mounting latches 94 with polarizing indicia 96 on the mating face 98. The pin insert also includes a plurality of profiled bores 100 each of which includes an inwardly directed locking flange 102 and a profiled sealing boot receiving portion 104.

The socket terminal 20 includes a mating portion 106 with a pin receiving bore 108, a conductor engaging portion 110, and a mounting portion 112, which engages the flanges 76 or 102 to secure the terminal in place. The mating pin terminal 22 has a mating pin portion 114, a mounting portion 116, and a conductor engaging portion 118.

The assembly further includes a plurality of sealing boots 120, each of which has an internal bore 122 for tightly engaging a conductor 124 and an external profile adapted to engage the portions 78, 104 of the respective inserts. A pair of rear gaskets 126 are also included, each having bores 128 for receiving the boots 120 therein and a sleeve portion 130 for engaging the rear portion of a respective insert. A compression ring 132 is provided to apply a compressive force to the rear gasket to insure the sealing. Likewise a compression cone strain relief 134 is provided to engage with appropriate threaded portions 38, 54 of the shell members and to apply pressure to the rear gasket 126 as well as provide for strain relief for the conductors 124. Interfacial seals 136 are provided inside of the profiled bores 100 of the pin insert. The coupling ring assembly 28 is used to draw the members together and to secure them in place and includes a cylindrical shell 138 having an inwardly directed flange 140 on one end, a cylindrical inner member 142 having an outwardly directed flange on a first end 144 and an inwardly directed flange 146 on the opposite end. A plurality of wave form washers 148 are mounted within the annular cavity defined between shell 138 and inner member 142 with the flanges 140 and 144 engaging the end most washers 148. An insert member 150 is secured in the other end of the cylindrical shell 138 and includes at least one internal helical groove 152. The insert member 150 restrains the movement of inner member 142 and the helical groove is used to engage a corresponding locking lug 36.

Figure 3:
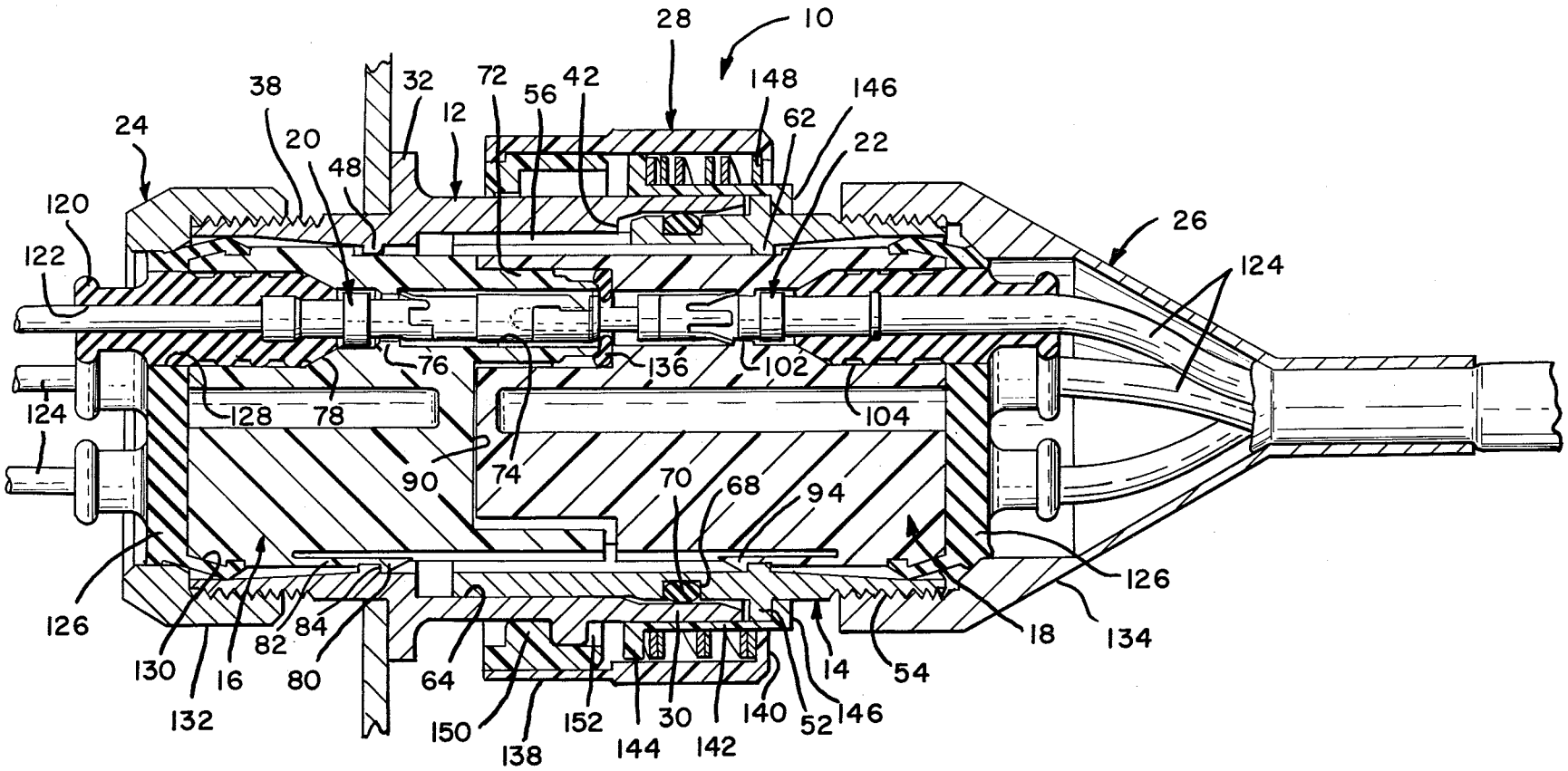
FIG. 3 is a longitudinal section through the subject electrical connector assembly in the mated condition.

The subject assembly can be put together in many ways because of the specialized configuration of the members. For example, a receptacle shell can have either a socket insert or a pin insert mounted therein any one of three polarized positions. As an illustrative example of an assembly of the present invention, reference will be made to FIGS. 1 and 3 in which a receptacle shell has a socket insert mounted therein with socket terminals mounted in the insert. Likewise the plug shell has a pin insert mounted therein with pin terminals mounted in the insert. To assemble this device the socket insert is placed in the receptacle shell keeping in mind that the polarizing will have to be observed by keeping the polarizing key 86 aligned in a proper polarizing keyway 50. The particular polarizing alignment will be noted by relating the indicia 88 in alignment with respect to the major key 42. The conductors 124 are passed through the bores 122 of the sealing boots 120, and each terminated with a socket terminal 20 in conventional fashion. This preferably is a crimp type engagement but any other known type of engagement will suffice. The socket terminals are then inserted through the rear gaskets 126 and into the respective bores until the locking portions 112 mate with the flange 76 to secure the terminals in place. The compression ring 132 is then threaded on to the external threads 38 and tightened to apply pressure to the rear gasket 126 and effect the sealing thereof. The receptacle portion can now be mounted on a bulkhead panel or the like in conventional fashion. The plug portion is assembled in a somewhat similar fashion to the receptacle portion in that the sealing boots 120 are passed over the conductors 124 and the pin terminals 22 secured thereon in known fashion. The terminals are then mounted in the bores of the pin insert until locked into position by the respective flanges 102. The interfacial seals 136 are inserted into bores 100. The O-ring 70 is inserted into groove 68 and the pin insert is inserted into the plug shell observing once again the engagement of the key 92 with the selected polarizing keyway 66. The correct alignment can be noted by the indicia 96 with respect to the keyway 56. The coupling ring is assembled, as previously described, and mounted on the plug member. The compression cone strain relief member 134 is threaded onto the threads 54 and tightened to apply compression to the rear sealing gasket 126. The strain relief cone can also be crimped to secure conductors 124 therein. The coupling ring is then fully rotatable on the plug with the longitudinal movement thereof restrained by the flange 52 and the compression cone strain relief member 134.

The assembled connector members are mated in conventional fashion with the major key and minor keys aligned with the respective major keyways and minor keyways and moved relative to each other to fully mate the pin and socket terminals. The members are then drawn together and secured to one another in a spring loaded condition by engagement of the grooves 152 of the coupling ring with the studs 36. Rotation of the coupling ring puts the spring washers under compression to resiliently load the coupled members.

The present invention may be subject to many modifications and changes without departing from the spirit or essential characteristics thereof. The present embodiment should therefore be considered in all respects as illustrative and not restrictive of the scope of the invention.

What is claimed is:

1. An environmentally sealed electrical connector assembly comprising:

a receptacle shell having a substantially cylindrical configuration including a profiled axial bore with at least one key extending therein;

a plug shell having a substantially cylindrical configuration having an external profile matable within said bore of said receptacle shell with at least one keyway recessed into the exterior of said plug shell and a profiled axial bore of like configuration to said profiled axial bore of said receptacle shell;

a socket insert having a substantially cylindrical external configuration adapted to be received in said axial bore of either of said shells and a plurality of terminal receiving passageways extending therethrough;

a like plurality of socket terminals each received in a respective passageway of said socket insert;

a pin insert having a substantially cylindrical external configuration adapted to be received in said axial bore of either of said shells and a like plurality of terminal receiving passageways extending therethrough;

a like plurality of pin terminals each received in a respective passageway of said pin insert;

polarizing means within the bore of each of said shells and on the exteriors of each said inserts allowing mounting of an insert in a respective shell with a specific orientation, said polarizing means including indicia at least on the faces of both said inserts to facilitate selection of the desired polarization;

means to environmentally seal rear end portions of each of said shells including a boot member engaging each conductor leading to a respective terminal, a rear gasket engaging a rear portion of said insert and having a planar portion with a plurality of bores, each receiving one of said boots therein in sealing engagement, and an integral annular sleeve portion;

compressive ring means engagable with the rear end of the respective shells and adapted to apply pressure to said gaskets with said planar portion forming a first seal between said gasket and each said boot member, a second seal between said gasket and the respective compressive ring and said sleeve portion forming a third seal between said shell and the respective insert received therein, interfacial seal means providing sealing between mating face portions of said inserts; and annular sealing means providing sealing between the mated shells.

2. An electrical connector assembly according to claim 1 further comprising:

mounting means integral with said receptacle shell to facilitate mounting of said receptacle shell on a panel and the like.

3. An electrical connector assembly according to claim 1 further comprising:

compressive ring means engagable with said rear end of said shells and adapted to apply pressure to a respective gasket, said ring means having a conical extension on one side forming a conductor guide.

4. An electrical connector assembly according to claim 3 wherein:

a free end portion of said conical extension is collapsible whereby said conductors are secured therein to provide strain relief.

5. An electrical connector assembly according to claim 1 further comprising:

coupling ring means for securing said shells together in spring loaded fashion, said coupling ring comprising:

an inner cylindrical member having an inwardly directed annular flange on one end and an outwardly directed annular flange on the opposite end, said inner member being movably mounted on said plug shell, an outer cylindrical member having an inwardly directed annular flange on one end and internal threads on the other end, and a plurality of wave form washers mounted in a chamber defined between said members and the outwardly directed flange of said inner member and the inwardly directed flange of outer member, whereby a biasing force is exerted on said plug shell by said washers as said coupling ring is threaded on said receptacle shell.

6. An electrical connector assembly according to claim 1 wherein said annular sealing means comprises:

a groove formed in the outer surface of said plug shell; and an O-ring seated in said groove, whereby a sealing engagement is effected between mated shells.

7. An environmentally sealed electrical connector member comprising:

a shell member of substantially cylindrical profile adapted to mate with a further shell member, said member having keying means and a profiled axial bore extending therethrough;

an insert member having an external profile adapted to be received within said profiled axial bore and a plurality of terminal receiving passageways extending therethrough, said insert member and said axial bore having polarizing means allowing mounting of said insert member in said axial bore with a member of predetermined orientations;

a like plurality of terminals each received in a respective passageway, each said terminal each having a mating portion, a mounting portion engagable in said passageway, and a conductor engaging portion and means to environmentally seal the rear end of said shell including a boot member engaging each conductor leading to a respective terminal, a rear gasket engaging a rear portion of said insert and having a planar portion with a plurality of bores, each receiving one of said boots therein in sealing engagement, and an integral annular sleeve portion, and compressive ring means engagable with the rear end of the shell and adapted to apply pressure to said gasket with said planar portion forming a first seal between said gasket and each said boot member, a second seal between said gasket and the respective compressive ring and said sleeve portion forming a third seal between said shell and the respective insert received therein;

interfacial seal means providing sealing between face portions of mating inserts; and annular sealing means providing sealing between mating shells.

8. An electrical connector member according to claim 7 wherein:

said shell member is a receptacle.

9. An electrical connector member according to claim 7 wherein:

said shell member is a plug.

10. An electrical connector member according to claim 7 wherein:

said insert member is a socket.

11. An electrical connector member according to claim 7 wherein:

said insert member is a plug.

12. An electrical connector member according to claim 7 wherein:

said at least one terminal is a pin.

13. An electrical connector member according to claim 7 wherein:

said at least one terminal is a socket.

* * * * *